US005797681A

United States Patent [19]

Triassi et al.

[11] Patent Number: 5,797,681

[45] Date of Patent: Aug. 25, 1998

[54] BATCH MIXER

[75] Inventors: Richard P. Triassi, Walworth; Vincent B. Dethier; Leroy Brown, Jr., both of Rochester, all of N.Y.

[73] Assignee: Eastman Kodak Company, Rochester, N.Y.

[21] Appl. No.: 753,074

[22] Filed: Nov. 20, 1996

[51] Int. Cl.[6] ..... B67D 5/60; B01F 15/02

[52] U.S. Cl. ..... 366/177.1; 366/181.1; 222/145.5

[58] Field of Search ..... 366/150.1, 166.1, 366/174.1, 177.1, 181.1, 183.1, 183.2, 183.4, 178.2; 396/564, 625; 222/81, 82, 88, 129.1, 132, 145.1, 145.5, 145.6, 83.5

[56] References Cited

U.S. PATENT DOCUMENTS

| | | | |
|---|---|---|---|
| 3,000,288 | 9/1961 | Winnek | 396/625 |
| 3,385,569 | 5/1968 | Bookout | 366/177.1 |
| 3,792,487 | 2/1974 | Peres | 396/625 |
| 3,949,902 | 4/1976 | Thompson | 222/129.1 |
| 4,035,818 | 7/1977 | King | 396/625 |
| 4,217,054 | 8/1980 | Gacki et al. | 366/177.1 |
| 5,102,010 | 4/1992 | Osgar et al. | 222/82 |

*Primary Examiner*—Tony G. Soohoo
*Attorney, Agent, or Firm*—Peyton C. Watkins

[57] ABSTRACT

A batch mixer for mixing a container of concentrate and diluent, the batch mixer comprises a mixing tank; and a drawer assembly for delivering the concentrate to said mixing tank. The drawer includes a multiple position receiving station for permitting the concentrate to be arranged in a plurality of configurations.

14 Claims, 2 Drawing Sheets

BATCH MIXER

FIELD OF THE INVENTION

The invention relates generally to the field of batch mixers and, more particularly, to a batch mixer which includes a translationally slidable, pull-out drawer having a funnel with a multiple position receiving station for receiving bottled concentrate in a plurality of predetermined positions.

BACKGROUND OF THE INVENTION

In a variety of fields, chemical solutions and mixtures are shipped as concentrates, which are later diluted with water for use in its intended purpose. Some diluted solutions, however, are not stable and, consequently, require that it be diluted immediately prior to its use. As is obvious to those skilled in the art, this further requires that the solution be mixed quickly and in small patches.

A variety of chemical mixers, such as the "KODAK" Automixer 3Plus, include an enclosed housing for containing the chemical mixing apparatuses. In one embodiment, a stationary loading portion is attached to the exterior of the enclosure for permitting the user to insert bottled solutions therein. In another embodiment, the drawer is moved into and out of the mixer by translational movement, and includes a plurality of tubes for transporting the concentrate to a mixing tank.

Although the presently known and utilized method and apparatus for mixing chemicals are satisfactory, they are not without drawbacks. A stationary loading portion consumes space surrounding the mixer and is also susceptible to inadvertent impacts from bypassing industrial equipment and personnel. In the translationally movable drawer, the tubes are susceptible to leaking and cracking which is obviously undesirable. In addition, the tubes are somewhat fragile and difficult to clean. Still further, in both configurations, the drawer assembly will only accept one type of bottle configuration.

Consequently, a need exists for improvements in the construction and mode of operating the drawer for overcoming the above-described drawbacks.

SUMMARY OF THE INVENTION

The present invention is directed to overcoming one or more of the problems set forth above. Briefly summarized, according to one aspect of the present invention, the invention resides in a batch mixer for mixing a container of concentrate and diluent, the batch mixer comprising: (a) a mixing tank; and (b) a drawer assembly for delivering the concentrate to said mixing tank, said drawer comprises: (b1) a multiple position receiving station for permitting the concentrate to be arranged in a plurality of configurations.

It is an object of the present invention to provide a chemical mixer which overcomes the above-described drawbacks.

It is an advantage of the present invention to provide a drawer for introducing the bottled solutions into the mixer which drawer substantially keeps two different solutions, which are substantially simultaneously introduced into the mixers, separate and distinct during the insertion for permitting proper mixing within the mixer.

It is a feature of the present invention to provide a drawer assembly which moves translationally for permitting access to its interior for ultimately delivering the concentrate to said mixing tank.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
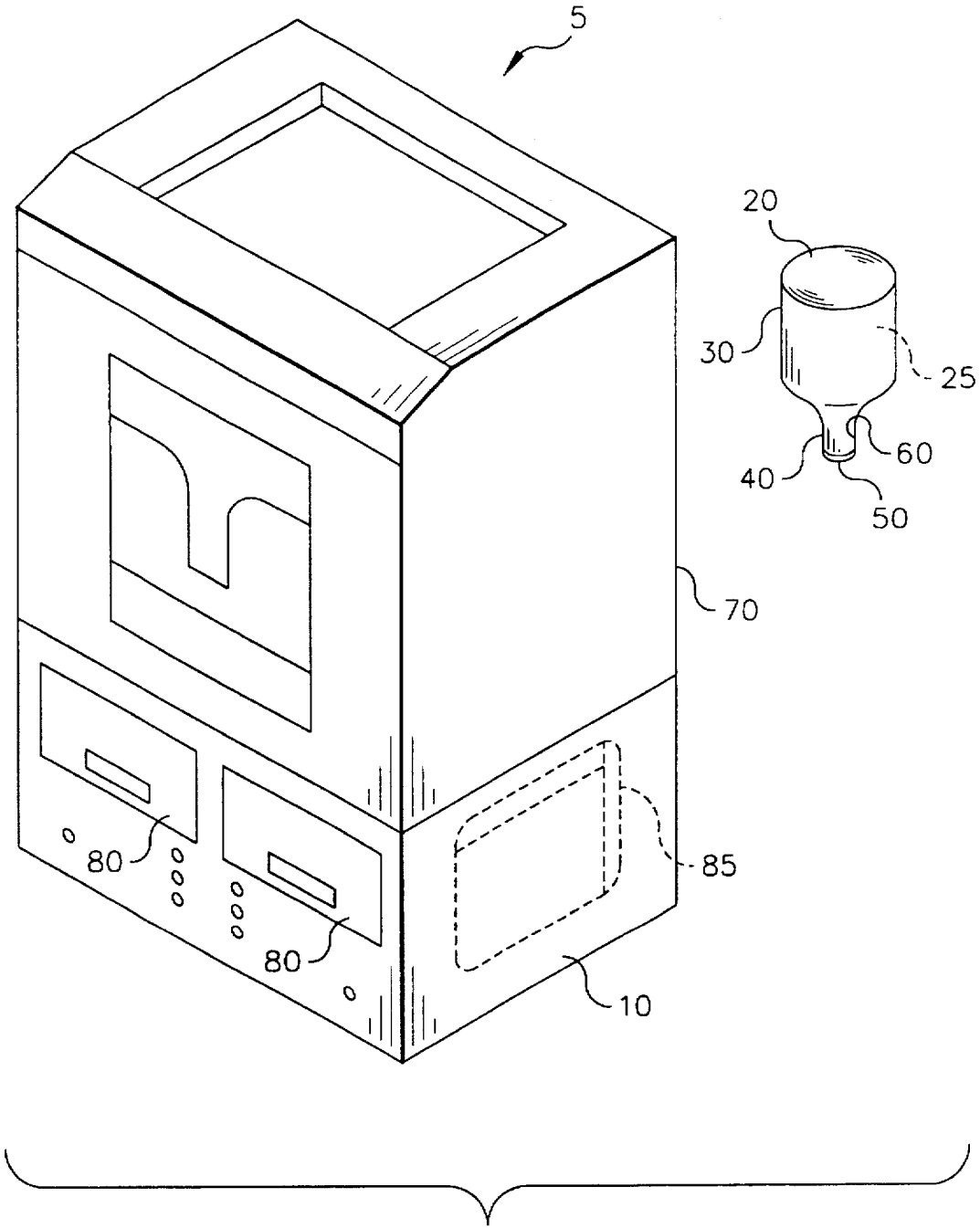
FIG. 1 is a perspective view of a batch mixer of the present invention.

In the following description, like reference characters designate like or corresponding parts throughout the several views of the drawings. Also in the following description, it is to be understood that such terms as "forward," "rearward," "left," "right," "upwardly," "downwardly," and the like are words of convenience and are not to be construed as limiting terms.

Referring to FIG. 1, there is illustrated a processor 5 positioned atop a batch mixer 10 which receives a bottle 20 containing concentrate 25. The bottle 20 includes a body 30 for storing the majority of the concentrate and a neck or spout 40 having a either a pierceable cap or foil 50 thereon enclosing an opening 60 in the spout for permitting the concentrate 25 therein to pass therefrom when the cap or foil 50 is pierced. Although the bottle 20 shown includes only one neck 40, the bottle 40 may include a plurality of necks 40 with an associated cap or foil 50 enclosing each opening 60; each neck extends from the body 30 for permitting substantially simultaneous pouring of the concentrate 25.

The mixer 10 includes a housing 70 for enclosing the components of the mixer 10. Two drawer assemblies 80 are positioned at an upper portion of the mixer 10 for receiving the bottle 20 of chemical concentrate 25. Each drawer assembly 80 includes means for piercing, as will be described in detail below, for permitting the concentrate to pass from the bottle 20, into the drawer assembly 80 and eventually into a mixing tank 85 where the concentrate 25 is diluted with water. The diluted concentrate then passes to the processor 5 where the diluted concentrate is used for processing film as is well known in the art.

Figure 2:
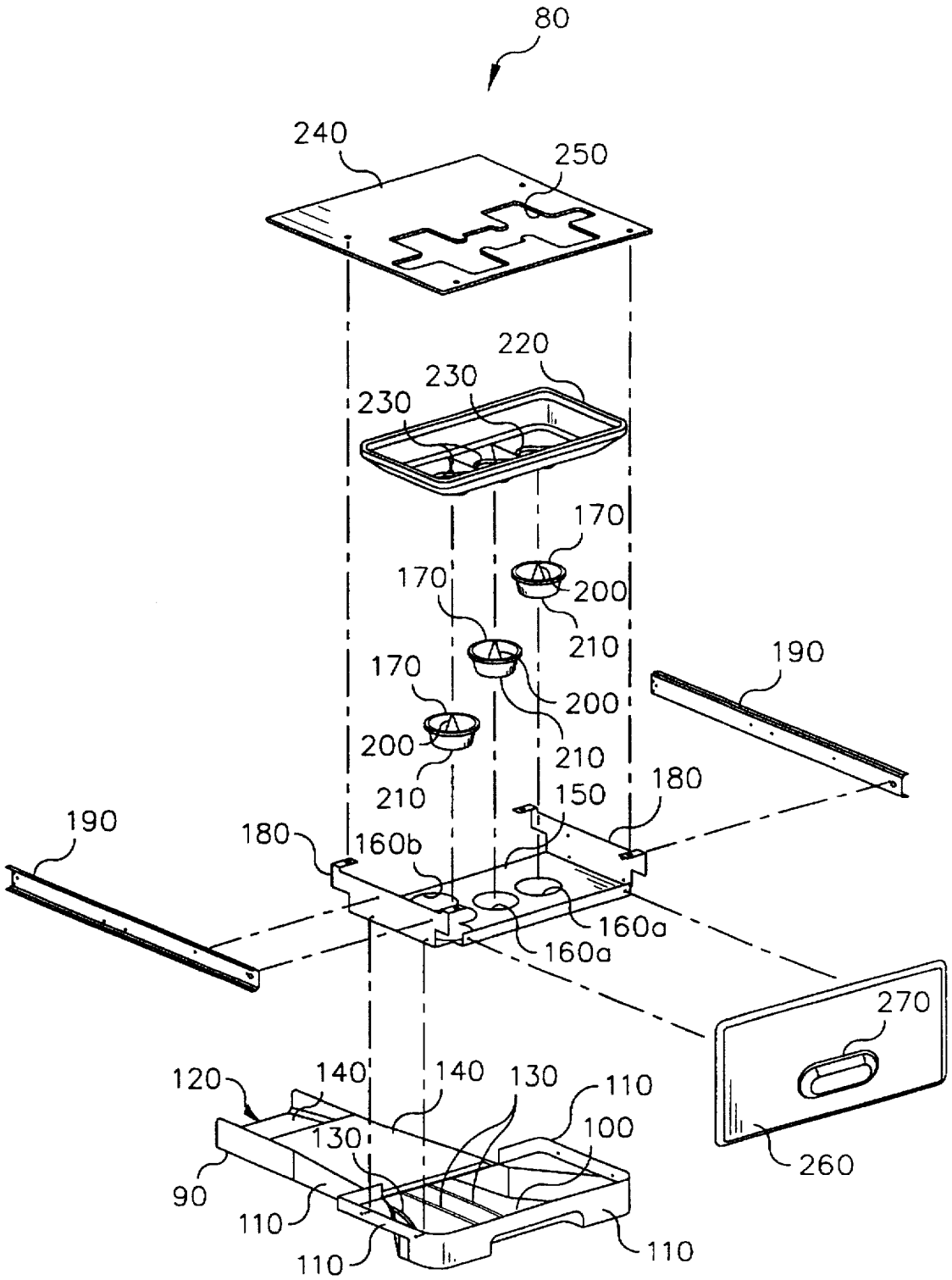
FIG. 2 is a perspective view of an assembly drawing of the drawer of the present invention.

Referring to FIG. 2, there is illustrated an exploded view of the drawer assembly 80 of the present invention. Although the mixer 10 includes two drawer assemblies 80, the below-described preferred embodiment is for both drawer assemblies 80. The drawer assembly 80 includes a funnel 90 for directing concentrate 25 into the mixing tank 85. The funnel 90 includes a floor 100 on which the concentrate 25 primarily flows and includes upwardly extending walls 110 attached to the floor 100 for containing the concentrate 25 within the funnel 90. The floor 100 extends the entire length of the funnel 90 and includes a slope for gravitationally forcing any concentrate thereon to flow backwardly toward a rear portion 120 of the funnel 90. Three separate ridges 130 rest in the center portion of the floor 100 for dividing the floor 100 into four portions for, consequently, maintaining the concentrate 25 along distinct flow paths along the floor. A covering portion 140 is attached to the wall 110 and is positioned over the rear portion 120 for containing any concentrate which splashes upwardly in the funnel 90, and for not permitting any water from mixing with the concentrate 25 before entering the mixing tank 85.

A plate 150 is attached via screws (not shown) to a portion of the wall 110. The plate 150 includes a plurality of holes 160 therein for each individually receiving a piercer 170. A portion of the holes 160*b* may overlap so that a piercer 170 may be placed in one or more of the overlapping holes 160*b*. Those skilled in art will readily recognize that, depending on the type of container, each hole 160 may or may not receive a piercer 170 so that the arrangement of the piercers 170 match the arrangement of the spouts 40 in the container 20. The plate 150 includes two upwardly extending side panels 180 integrally attached to the plate 150. Each panel 180 attaches to a rail 190 via screws (not shown) for permitting each rail 190 to roll on a ball bearing slide (not shown) disposed in the mixer 10 for ultimately permitting the drawer assembly 80 to be translationally pulled out of the mixer 10.

The piercers 170 each include a pointed knife 200 having a plurality of slits therein for permitting the pointed knife 200 to pierce the bottled concentrate 20 and the concentrate 25 which consequently flows therefrom to flow through the slits and eventually onto the floor 100. Each piercer 170 also includes a cup 210 for containing and directing the concentrate 25 from the bottle 20 back through the slits. The cup 210 is hollowed-out at its center portion below the pointed knife 200 for permitting access of the concentrate 25 to the floor 100.

A nest 220 rests over the plate 150 and also includes three openings 230 therein which substantially align with the holes 160. Although three openings 230 are shown, those skilled in the art will recognize that the number of openings preferably match the number of piercers 170 used. The nest 220 minimizes and captures any spillage resulting from piercing the bottle concentrate 20 for ultimately redirecting the concentrate 25 back through the piercer 170. A template 240 is disposed over the nest 220 and plate 150 and is attached to the plate 150 via screws (not shown). A cut-away portion 250 is disposed in the template 240 to permit proper alignment of the bottle 20 of concentrate which is inserted into the drawer assembly 80. The template 240 also applies pressure downwardly for maintaining the nest 220 and piercers 170 in their positional relationship.

A drawer front 260 is placed on the front of the drawer assembly 80 and attaches to the plate 150 also via screws (not shown) for permitting a user to grasp its handle 270 for translationally sliding the drawer assembly 80 into and out of the mixer 10.

For using the drawer assembly 80, the user pulls the handle 260 for translationally sliding the drawer assembly 80 out of its closed position for exposing the interior of the drawer assembly 80. A bottle 20 of concentrate is placed into the drawer assembly 80 so that its neck 40 extends into both the cut-away portion 250 and the opening 230 for striking the bottle cap or foil 50 on the pointed end of the knife 200, which consequently causes the concentrate 25 therein to flow out of the bottle 20. The template 240 and nest 220 both function to hold the bottle 20 in the inverted position (bottle cap or foil 50 pointing downwardly as illustrated in FIG. 1). The concentrate 25 flows through the slits in the knife 200 and onto the floor 100 of the funnel 90.

The concentrate 25 flows to the rear portion 120 of the funnel 90, and then passes to the mixing tank 90 where the concentrate 25 is diluted with water which pours onto a lower portion of the covering portion 140 and cascades into the mixing tank 85, as is well known in the art. The diluted concentrate is then passed to the processor 5 where the diluted concentrate is used for processing film, as is well known in the art The invention has been described with reference to a preferred embodiment. However, it will be appreciated that variations and modifications can be effected by a person of ordinary skill in the art without departing from the scope of the invention.

Parts list:

5 processor
10 batch mixer
20 bottle
25 concentrate
30 body
40 spout
50 cap or foil
60 opening
70 housing
80 drawer assemblies
85 mixing tank
90 funnel
100 floor
110 extending walls
120 rear portion
130 ridges
140 covering portion
150 plate
160 holes
170 piercer
180 side panels
190 rail
200 pointed knife
210 cup
220 nest
230 openings
240 template
250 cut-away portion
260 drawer front
270 handle

We claim:

1. A batch mixer for mixing a container of concentrate and diluent, the batch mixer comprising:

(a) a mixing tank; and (b) a means to provide a diluent into said mixing tank; and (c) a movable drawer assembly in fluid connection with said mixing tank for delivering the concentrate to said mixing tank, said drawer assembly receiving at least one container including a pouring spout for holding the concentrate, said drawer assembly comprising:

(c1) a multiple position receiving station for permitting the arrangement of a respective pouring spout of each of container of concentrate to be placed in two or more positions in said drawer assembly.

2. The batch mixer as in claim 1, wherein said multiple position receiving station further comprises a plate having a plurality of holes therein for receiving the spouts.

3. The batch mixer as in claim 2, wherein said multiple position receiving station includes a nest disposed adjacent said plate and having a plurality of holes therein substantially aligned with the holes in the plate.

4. The batch mixer as in claim 3, wherein said multiple position receiving station includes a template disposed adjacent said nest.

5. The batch mixer as in claim 1 further comprising a funnel disposed adjacent said multiple position receiving station and having a single transport floor, said single transport floor receiving a flow of concentrate from said multiple position receiving station, and having means for substantially maintaining the flow of concentrate into separate predetermined flowpaths.

6. The batch mixer as in claim 5, wherein said means for substantially maintaining the flow of concentrate into separate predetermined flowpaths includes a plurality of ridges on the floor.

7. The batch mixer as in claim 1 further including a housing for enclosing the drawer assembly, wherein said drawer assembly moves translationally into and out of the housing of the batch mixer.

8. The batch mixer as in claim 7, wherein the means to provide a diluent into said mixing tank includes a means for directing water into the mixing tank separately from the concentrate.

9. A batch mixer for mixing a concentrate and diluent, the batch mixer comprising:

(a) a mixing tank; and (b) a means to provide a diluent into said mixing tank; and (c) a movable drawer assembly in fluid connection with said mixing tank for delivering the concentrate to said mixing tank, said drawer assembly receiving at least one container of concentrate having a pouring spout, said drawer assembly comprising:

(c1) a funnel having a single transport floor, said floor including a ridge for receiving the concentrate and substantially maintaining the concentrate into separate predetermined flow paths.

10. The batch mixer of claim 9 further comprising a multiple position receiving station in fluid connection to said funnel, the multiple position receiving station permitting the arrangement of a respective pouring spout of each container of concentrate to be placed in two or more positions on the multiple position receiving station.

11. The batch mixer as in claim 10, wherein said multiple position receiving station further comprises a plate having a plurality of holes therein for receiving the spouts.

12. The batch mixer as in claim 11 wherein said multiple position receiving station includes a nest, which is disposed adjacent said plate, and which includes a plurality of holes therein substantially aligned with the holes in the plate.

13. The batch mixer as in claim 12, wherein said multiple position receiving station includes a template disposed adjacent said nest.

14. The batch mixer as in claim 9, further including a housing for enclosing the drawer assembly, wherein said drawer assembly moves transnationally into and out of the housing of the batch mixer.

* * * * *